US005839160A

United States Patent [19]

Wang et al.

[11] Patent Number: 5,839,160

[45] Date of Patent: Nov. 24, 1998

[54] CLUTCH CONTROL MECHANICAL DEVICE FOR THE BRUSH AXLE OF A VACUUM CLEANER

[75] Inventors: Chieh-Chun Wang; Chia-Ming Lin, both of Taichung, Taiwan

[73] Assignee: Kinergy Industrial Co., Ltd., Taichung, Taiwan

[21] Appl. No.: 804,347

[22] Filed: Feb. 21, 1997

[51] Int. Cl.[6] ..... A47L 9/00

[52] U.S. Cl. ..... 15/390; 15/361

[58] Field of Search ..... 15/332, 361, 390, 15/410

[56] References Cited

U.S. PATENT DOCUMENTS

| | | | |
|---|---|---|---|
| 4,446,595 | 5/1984 | Nakada et al. | 15/390 X |
| 4,637,092 | 1/1987 | Hayashi et al. | 15/390 X |
| 4,648,150 | 3/1987 | Morishita et al. | 15/390 X |
| 4,686,736 | 8/1987 | Petralia et al. | 15/390 X |
| 4,748,714 | 6/1988 | Tschudy | 15/390 |
| 5,331,716 | 7/1994 | Hemmann et al. | 15/390 X |

*Primary Examiner*—Chris K. Moore
*Attorney, Agent, or Firm*—Bacon & Thomas

[57] ABSTRACT

A clutch control mechanical device is disclosed for the brush axle of a vacuum cleaner. The clutch control mechanical device is located at the undercarriage of the machine with a pressure control shaft extending out of the inner sides of the undercarriage. At the corresponding position, the underside of the upper body joining the undercarriage is equipped with a pressure control piece so that when the upper body is in a vertical position to the undercarriage, the pressure control piece shall press down on the pressure control shaft of the clutch control mechanical device which suspends rotation of the brush axle. When the upper body is in a slanted angle to the undercarriage, the removal of external force shall return the pressure control shaft to its original position by a spring bias which rotates the brush axle.

6 Claims, 6 Drawing Sheets

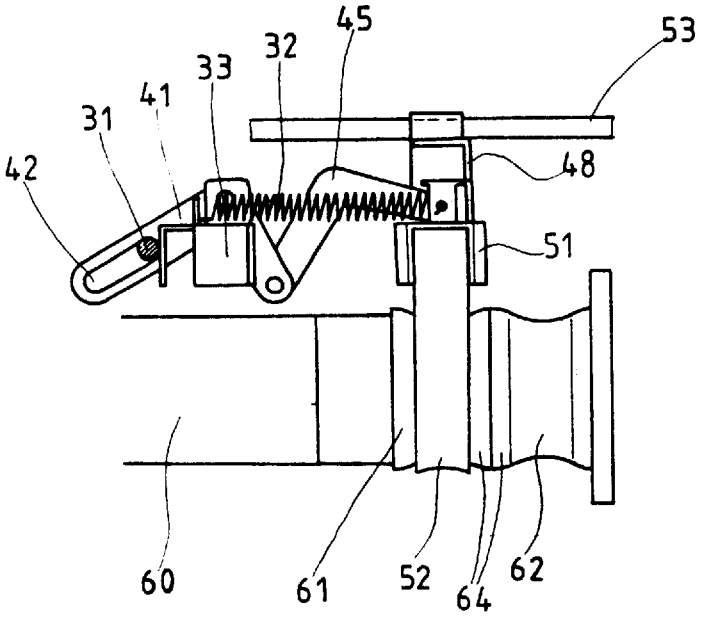
FIG.4-A
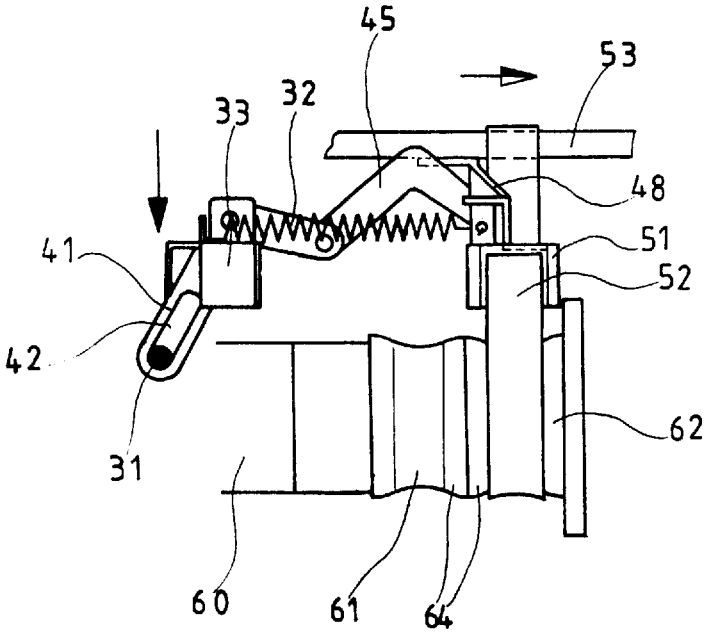
FIG.4-B

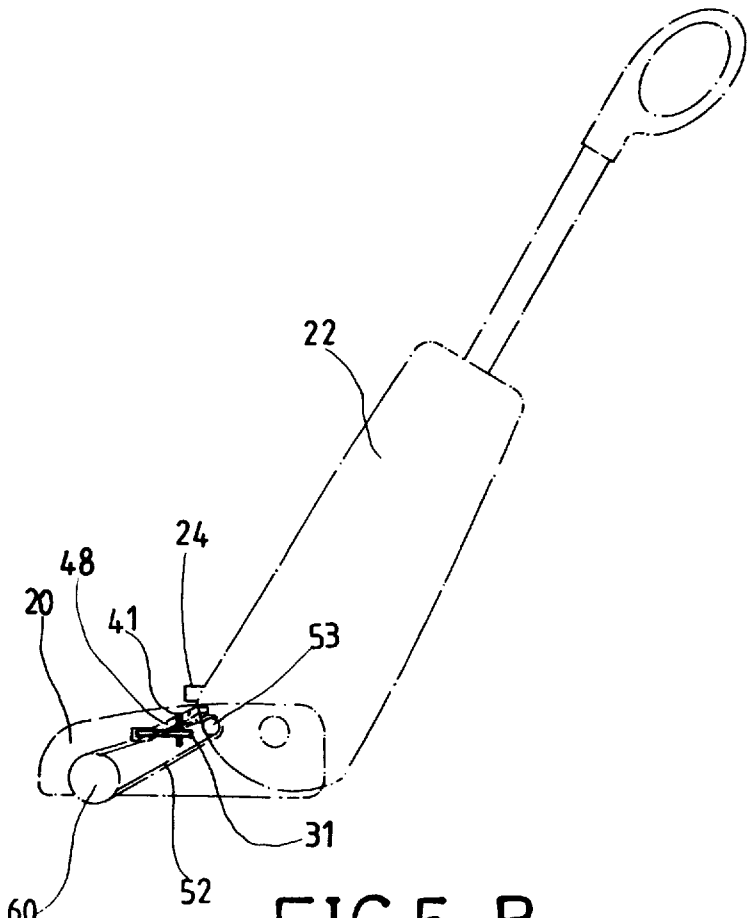
FIG. 5-B
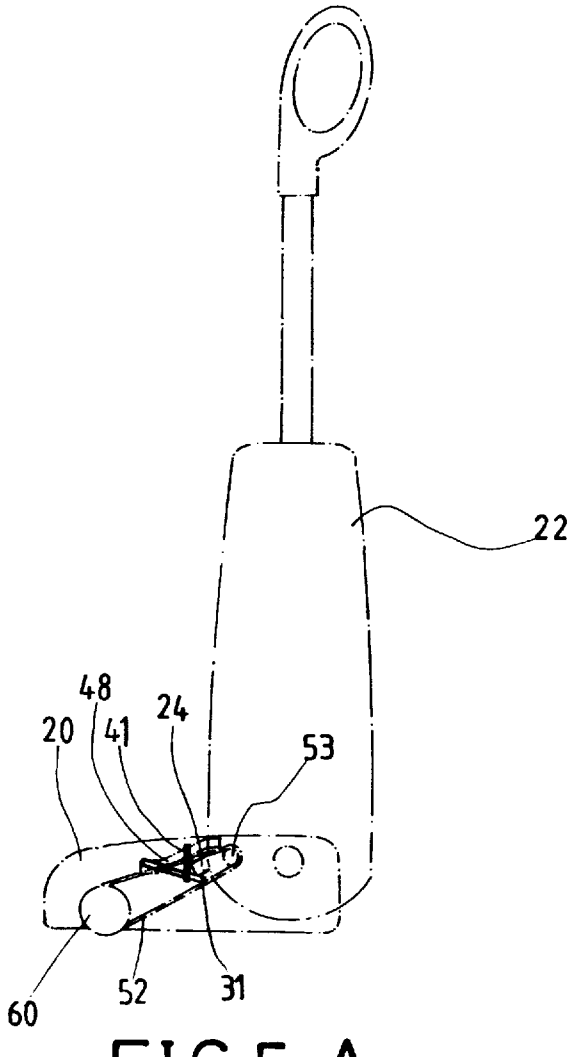
FIG. 5-A

CLUTCH CONTROL MECHANICAL DEVICE FOR THE BRUSH AXLE OF A VACUUM CLEANER

BACKGROUND OF THE INVENTION

This invention is related to a clutch control for the brush axle of a vacuum cleaner. More specifically, the invention pertains to a function which controls initiating or terminating the motion of the brush axle by the vertical or slanted angles of a machine's upper body.

The conventional vacuum cleaner is as shown in FIG. 1 which consists of an upper body (11) with a handle (10) and an undercarriage (12). The front end of the undercarriage (12) has a brush axle (13) driven by a motor (not shown). One side of the upper body (11) is equipped with a hose (14). Thus, for vacuum application, the power switch (17) is turned on for fast rotation of the brush axle (13) which picks up and draws in dust and dirt along with the functions of the suction orifice (not shown) on the undercarriage (12) and suction pump (not shown). For holding and moving the machine, the upper body (11) is at a slanted angle to the undercarriage (12).

Furthermore, if the vacuum cleaner is used in cleaning curtains and articles in high positions, such as tables and chairs, the upper body (11) must be returned to the upright position to prevent the machine from overturning. The switch knob (15) on the surface of the undercarriage (12) is used to suspend rotation of the brush axle (13). At this time, the suction pump is still in operation so that the movable hose (14) can be used to perform vacuuming.

During the entire cleaning task, the clutch control mechanical device (16) of the brush axle must be repeatedly switched on and off according to space and environment, which generates operating inconveniences.

SUMMARY OF THE INVENTION

Consequently, great effort has been invested into this invention to improve on the clutch control function of the brush axle of a vacuum cleaner with the objective direct control of the brush axle function by the vertical or slanted angles of the machine's upper body.

A clutch control mechanical device is disclosed for the brush axle of a vacuum cleaner. The clutch control mechanical device is located at the undercarriage of the machine with a pressure control shaft extending out of the inner sides of the undercarriage. At the corresponding position, the underside of the upper body joining the undercarriage is equipped with a pressure control piece so that when the upper body is in a vertical position to the undercarriage, the pressure control piece shall press down on the pressure control shaft of the clutch control mechanical device which suspends rotation of the brush axle. When the upper body is in a slanted angle to the undercarriage, the removal of external force shall return the pressure control shaft to its original position by a spring bias which rotates the brush axle.

The technical skill, approach and attained function related to this invention are detailed in the following along with drawings.

BRIEF DESCRIPTION OF THE DRAWINGS

FIG. 4A is a partial elevational view showing the clutch control device of this invention for the brush axle of a vacuum cleaner with the brush axle rotating.

FIG. 4B is a partial elevational view showing the clutch control device of this invention for the brush axle of a vacuum cleaner with the brush axle non-rotating.

FIG. 5A is a side view of the clutch control device of this invention for the brush axle of a vacuum cleaner with the brush axle non-rotating.

FIG. 5B is a side view of the clutch control device of this invention for the brush axle of a vacuum cleaner with the brush axle rotating.

DETAILED DESCRIPTION OF THE PREFERRED EMBODIMENT

Figure 1:
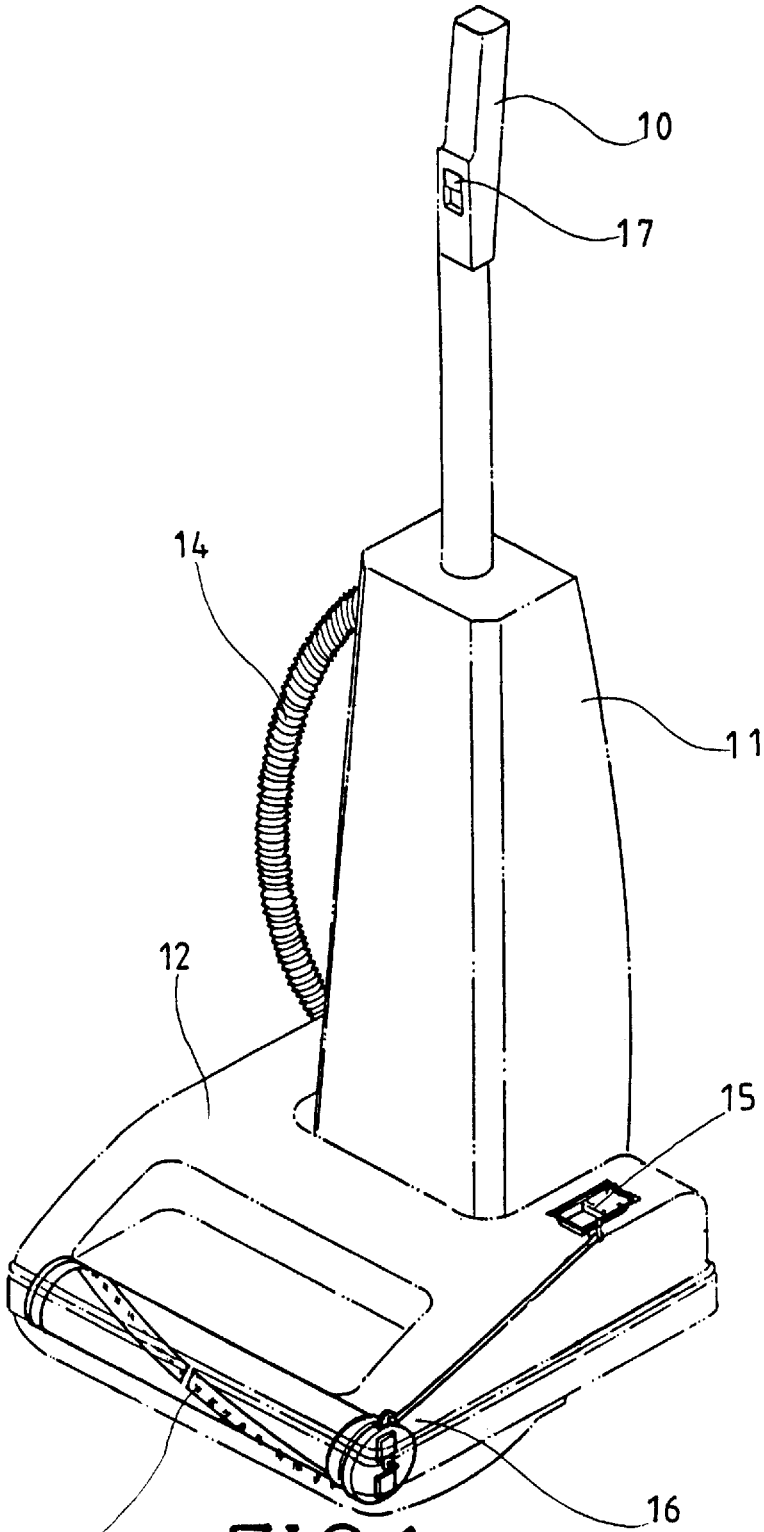
FIG. 1 PRIOR ART
FIG. 1 is a perspective view showing the clutch control device for the brush axle of a conventional vacuum cleaner.
Figure 2:
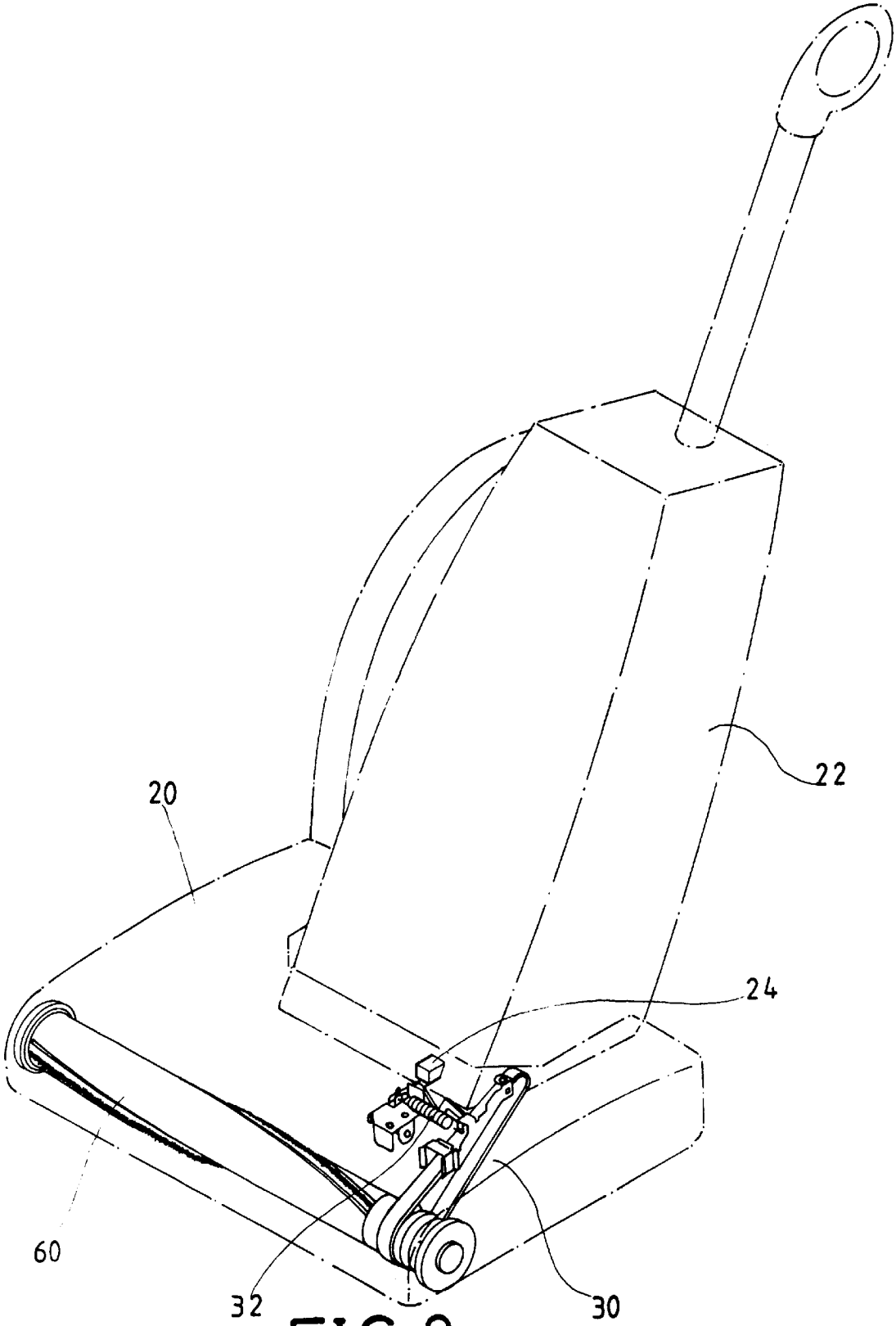
FIG. 2 is a partial perspective view showing the clutch control device of this invention for the brush axle of a vacuum cleaner.

As shown in FIGS. 2 and 5, the undercarriage (20) contains a clutch control device (30) with the pressure control shaft (31) extending out from the inner sides of the undercarriage (20). A corresponding position of the underside of the upper body (22) joining the undercarriage (20) is equipped with a pressure control piece (24) so that when the upper body (22) is in a vertical position relative to the undercarriage (20), the pressure control piece (24) shall press down on the pressure control shaft (31) of the clutch control mechanical device (3) which suspends rotation of the brush axle (60) (as shown in FIG. 5A). When the upper body (22) is in a slanted angle relative to the undercarriage (20), the removal of external force returns the pressure control shaft (31) to its original position by the force of the spring (32) which rotates the brush axle (60) for convenient application.

Figure 3:
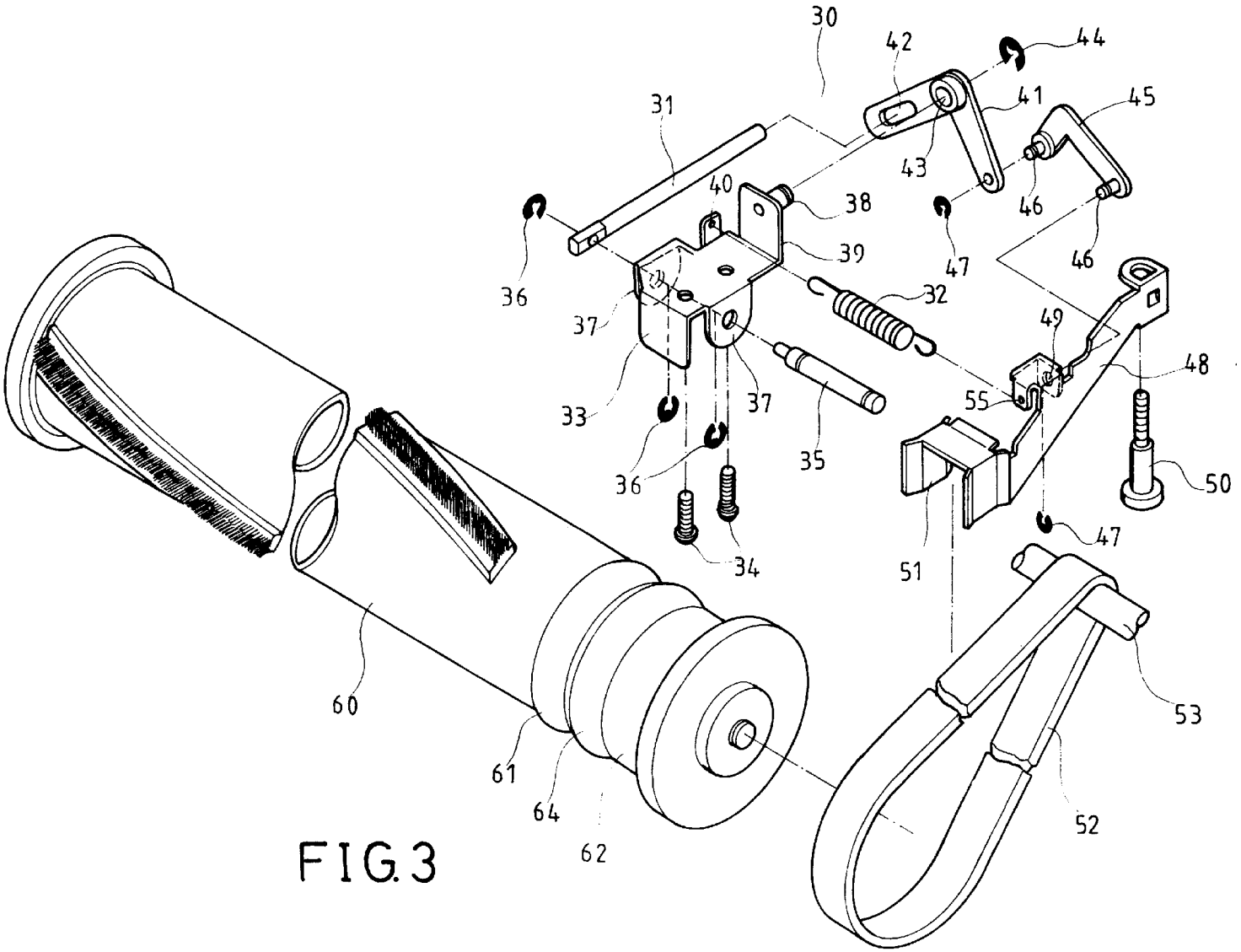
FIG. 3 is an exploded perspective view of the clutch control device of this invention for the brush axle of a vacuum cleaner.

The structure of the clutch control device (3) is as shown in FIG. 3 and includes: A station mount (33) which is secured by 2 screws (34) from the bottom up in an appropriate location on the inner top of the undercarriage (2). A station axle (35) and hook rings (36) are used to secure the pressure control shaft (31) onto the side of the downward flap (37). A front edge has an upward flap (39) with a projecting shaft (38); a hook hole (40) is located on the front end of the flat surface for one end of the spring (32) to hook onto.

The first L-shape plate (41) has a gliding slot (42) on one end of the plate (41) for the pressure control shaft (31) to pass through. The centre hole (43) along with a hook ring (44) are applied to secure the L-shape plate (41) to the projecting shaft (38).

Inserting shafts (46) are located on each side of the second L-shape plate (45) and are secured to an end of the first L-shape plate (41) and to the connecting flap (49) of the belt mount (48) respectively by hook rings (47).

The belt mount (48) is slanted in shape; the front edge is secured onto an inner top of the undercarriage (20) with a screw axle (50); the sides have an insert flap (49) and a hook flap (55). The end of the belt mount (48) has a hood shaped cover (51). After assembly, the screw (50) serves as a shaft for the rotation of the belt mount (48).

The propelling belt (52) is mounted on the extended central shaft (53) of a motor (not shown) and the propelling wheel (61) or the suspended wheel (62) of the brush axle (60).

One side of the brush axle (60) has an external suspended wheel (62) and a propelling wheel (61). When the clutch control mechanical device (30) is assembled, the hood shaped cover (51) of the belt mount (48) shall properly fit over the propelling belt (52).

Consequently, when the pressure control shaft (31) receives no external force, the hood shaped cover (51) locates the propelling belt (52) to the location of the propelling wheel (61) to rotate the brush axle (60) as shown in FIG. 4A. When the pressure control shaft (31) receives external force, the belt mount (48) shall move to the right due to the connection of the first L-shape plate (41) and the second L-shape (45) which shall cause the other end of the second L-shape plate (45) to propel the belt mount (48) to the right about the screw axle (50) and push the hood shaped cover (451) to an off-right position. The propelling belt (52) is then driven toward the outer right direction of the brush axle (60) to the position of the suspended wheel (62) to render the brush axle (60) motionless as shown in FIG. 4B. At this time, the spring (32) is in a stretched state.

Moreover, when the external force is removed from the pressure control shaft (31), the spring (32) shall return to its original state (shown in FIG. 4A) and pull the hood shaped cover (51) of the belt mount (48) to its original position, forcing the propelling belt (52) back to the position on the propelling wheel (61).

The main principle applied for the hood shaped cover (51) to move the propelling belt (52) is based on high pressure moving nature of the propelling belt (52) along with the curve surface design (64) of the contact surfaces of the propelling wheel (61) and the suspended wheel (62) in producing excellent and fast moving function.

Figure 6:
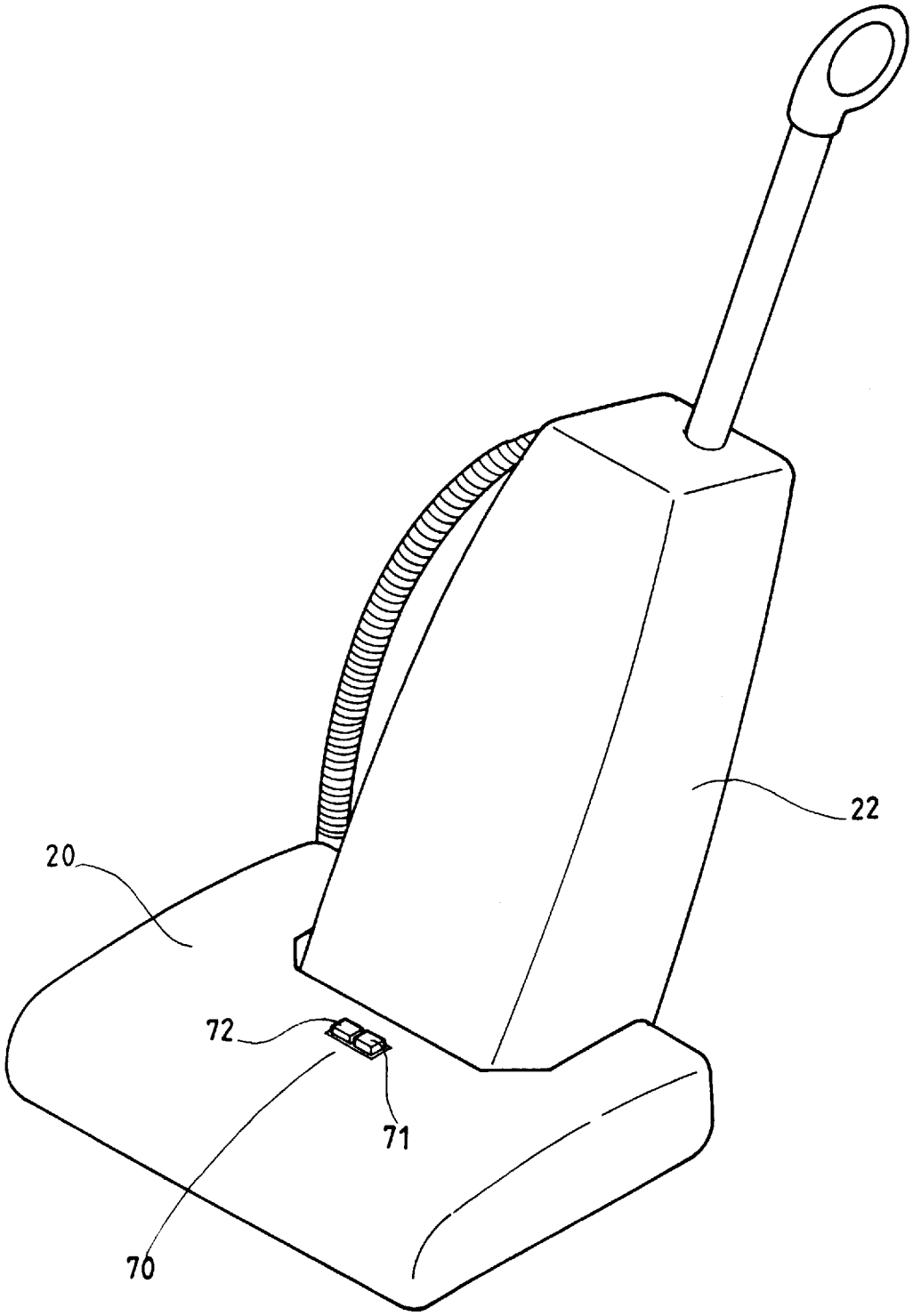
FIG. 6 is a perspective view of a vacuum cleaner according to the present invention.

Lastly, please refer to FIG. 6 for an example of this invention. A switch set (70) can be located on the top of the undercarriage (20) so that when the first control button (71) is pressed, the pressure control shaft (31) of the clutch control device (30) is pressed down to suspend rotation of the brush axle (60). At this time, the pressure control piece (24) of the upper body (22) shall lose its function for the time being. Press the second control button (72) for the first control button (71) to return to its original position and to activate the rotation of the brush axle (60); at this time, the pressure control shaft (31) shall return to its original position, and control of the clutch control device (30) shall be returned to the pressure control piece (24) of the upper body (22).

The foregoing description is provided for illustration purposes only and should not be construed as in any way limiting the present invention, the scope of which is defined solely by the appended claims.

It is claimed:

1. A clutch mechanism for a vacuum cleaner having an undercarriage with a rotatable brush axle connected to an endless belt that is movable between driving and non-driving positions, and an upper body movably attached to the undercarriage so as to be movable between an upright position and an oblique position, the clutch mechanism comprising:

a) a pressure control shaft movably connected to the undercarriage and in contact with the upper body so as to move between first and second positions as the upper body moves between the upright and oblique position;

b) a belt mount member pivotally connected to the undercarriage and having a portion engaging the endless belt whereby pivoting movement of the belt mount member moves the endless belt between the driving and non-driving positions;

c) a spring acting on the belt mount member so as to bias the belt mount member toward a position in which the endless belt is in the driving position;

d) a first pivoting plate in contact with the pressure control shaft whereby movement of the pressure control shaft causes pivoting movement of the first pivoting plate; and, e) a second pivoting plate connected to the first pivoting plate and to the belt mount member, whereby when the upper body is in the upright position the endless belt is in the non-driving position and when the upper body is in the oblique position, the endless belt is in the driving position.

2. The clutch mechanism of claim 1 wherein the first pivoting plate is substantially L-shaped.

3. The clutch mechanism of claim 1 wherein the second pivoting plate is substantially L-shaped.

4. The clutch mechanism of claim 1 wherein the belt mount member has a substantially U-shaped hood cover through which the endless belt passes.

5. The clutch mechanism of claim 1 further comprising a pressure control piece attached to the upper body so as to contact the pressure control shaft when the upper body is in the upright position.

6. The clutch mechanism of claim 1 further comprising:

a) a first control button on the undercarriage to manually move and hold the pressure control shaft in the first position whereby the endless belt is in the non-driving position; and, b) a second control button on the undercarriage to release the first control button enabling the pressure control shaft to be controlled by the position of the upper body.

* * * * *